United States Patent [19]

Roe

[11] Patent Number: 4,702,220

[45] Date of Patent: Oct. 27, 1987

[54] ATOMIZING VALVE APPARATUS FOR INTERNAL COMBUSTION ENGINE

[76] Inventor: Douglas A. Roe, 124 West Julie, Tempe, Ariz. 85283

[21] Appl. No.: 13,359

[22] Filed: Feb. 11, 1987

[51] Int. Cl.[4] ..... F02M 29/04

[52] U.S. Cl. ..... 123/593; 48/189.4; 123/52 M

[58] Field of Search ..... 123/590, 593, 52 M; 48/189.4, 189.5

[56] References Cited

U.S. PATENT DOCUMENTS

| | | | |
|---|---|---|---|
| 3,945,361 | 3/1976 | Piotrowicz | 123/590 |
| 4,187,820 | 2/1980 | Webster et al. | 123/593 |
| 4,285,320 | 8/1981 | Webster et al. | 123/590 |

*Primary Examiner*—E. Rollins Cross

*Attorney, Agent, or Firm*—Don J. Flickinger; Jordan M. Meschkow

[57] ABSTRACT

A tubular body projects through the normal inlet opening in the inlet manifold of a conventional internal combustion engine. The quantity of fuel mixture flowing through the bore in the body is controlled by a throttle valve which is reciprocally movable relative the discharge end of the body which resides within the manifold. Biasing means normally retracts the valve to an engine idle position. The valve is extended in response to engine demand. Droplets of liquid within the fuel mixture are atomized in response to an annular deflector which directs the mixture from the sidewall of the bore to be impinged upon the planar surface of the valve. A stationary screen encompassing the valve further atomizes the mixture. Baffels are provided to direct the fuel charge toward the combustion chambers.

11 Claims, 5 Drawing Figures

ATOMIZING VALVE APPARATUS FOR INTERNAL COMBUSTION ENGINE

BACKGROUND OF THE INVENTION

1. Field of the Invention

This invention relates to internal combustion engines.

More particularly the present invention relates to devices for use in connection with the fuel induction system of an internal combustion engine.

In a further and more specific aspect, the instant invention concerns an apparatus for regulating and atomizing the fuel mixture entering the intake manifold.

2. The Prior Art

It is well known that controlled and regulated delivery of the fuel charge, an air and liquid mixture, to the one or several combustion chambers of an internal combustion engine contributes greatly to efficiency and performance. Ideally, the fuel mixture should be homogeneous and supplied in accordance with demand. Droplets of fuel, not sufficiently ethereal to remain entrained within the vaporous mixture, will settle and pool within the intake manifold. A fuel mixture supply, not in accordance with engine requirements will deleteriously effect performance. Either condition results in less than economical operation.

The carburetor, the conventional standard for generating the fuel mixture and providing the charge to the engine, is notoriously inadequate. Liquid fuel, drawn into the air stream in response to venturic effect, is neither finely divided nor thoroughly mixed. Air and/or fuel can be supplied in gross disproportion to engine requirements. The throttle valve, a plate rotatably mounted with the path of the fuel mixture, inherently disrupts the direction of flow. The device is wrought with other characteristic deficiencies as will be readily recognized by those skilled in the art.

Various purported solutions to the foregoing problems have been devised by the prior art. The contrivances range from simple accessory devices to elaborate and complex schemes. The less complicated devices, generally inexpensive and adapted to be installed by the relatively untrained do-it-yourselfers, have not achieved any marked degree of success. Sophisticated apparatus, including alternate fuel supply systems, have been successful in enhancing fuel economy and engine performance. However, such apparatus are exceedingly expensive and require attention by highly skilled technicians.

Recently, the art has directed attention to providing a comparatively inexpensive, yet effectively functioning alternative. Especially noted is the variable atomizing valve devised to be interposed between the intake manifold and a conventional carburetor. The device sought to improve fuel economy, enhance engine performance, and reduce emissions. Atomization of fuel was deemed to contribute substantially to the achievement of these objectives.

The variable atomizing valve, however, was never able to satisfactorily achieve the intended objects. Unduly encumbered structure contributed to cost and fragility. Exemplary is the intricate assembly of telescopingly engaging screen sleeves which presented the probability for malfunction. The structure also thwarted the realization of the full potential of which the theory was possible. For example, while having provisions to atomize fuel, the devices also included self-defeating limitations.

SUMMARY OF THE INVENTION

In view of the foregoing it would be highly advantageous to remedy the noted and other deficiencies inherent in the prior art.

Accordingly, it is an object of the present invention to provide an improved apparatus for regulating and controlling the fuel charge supplied to an internal combustion engine.

Another object of the invention is the provision of improved means for atomizing the liquid in an air/fuel mixture.

And another object of the invention is to provide improved means for making the fuel mixture available in accordance with engine demand.

Still another object of the instant invention is the provision of an atomizing valve apparatus which is usable in combination with various fuel supply means such as carburetors and fuel injection systems.

Yet another object of the invention is to provide a valve apparatus which can replace the throttle plate in a conventional carburetor.

Yet still another object of this invention is the provision of an apparatus which can direct fuel mixture for uniform distribution to the several cylinders of an internal combustion engine.

And a further object of the invention is to provide a variable fuel control valve having primary and secondary means for optimizing fuel particle size.

Still a further object of the immediate invention is the provision of an atomizing valve apparatus which is relatively unencumbered for increased reliability and decreased maintenance.

Yet a further object of the invention is to provide an atomizing valve apparatus which can be readily and easily adjusted to accommodate the engine upon which it is installed.

And yet a further object of the invention is the provision of an apparatus according to the foregoing which is adaptable to original equipment manufacture or retrofit to pre-existing engines.

Briefly, to achieve the desired objects of the instant invention, in accordance with a preferred embodiment thereof, there is first provided a body including a bore having a continuous sidewall and adapted to be interposed between the fuel supply means and the inlet manifold of the fuel induction system of an internal combustion engine. An air and liquid fuel mixture from the fuel supply means is received into the inlet end of the bore. The discharge end of the bore communicates with the intake manifold.

Next provided are valve means including a throttle valve residing in the normal pass of the fuel mixture existing from the discharge end of the bore. Guide means couples the valve means to the body for reciprocal movement of the throttle valve in extendible and retractable directions relative the discharge end of the bore. Biasing means normally urge the throttle valve in the retractable direction. The throttle valve is movable in the extendible direction in response to vacuum in the intake manifold.

In accordance with a more specific embodiment, the throttle valve includes a surface which cooperates with the discharge end of the bore for directing the fuel mixture to flow substantially radially outward from the bore. Baffle means may also be provided to urge the flow in a direction generally toward the combustion chambers. The surface also cooperates with the discharge end of the bore for at least partially atomizing the liquid in the fuel mixture. Further atomizing effect is gained by deflector means carried within the bore for lifting the fuel mixture from the sidewall of the bore and directing the mixture to a more central location of the surface of the throttle valve.

In a still further embodiment of the invention, there is provided additional atomizing means for intercepting the fuel mixture prior to entering the inlet manifold. Preferably, the additional atomizing means is in the form of a screen element stationarily depending from the discharge end of the bore and encompassing the throttle valve.

Further contemplated by the instant invention are stop means for limiting the movement of the throttle valve in the retractable direction. Preferably, the stop means are selectively adjustable. In an embodiment thereof, a shaft extends from the throttle valve in a direction toward the inlet end of the bore. An adjustably positionable stop member receives the free end of the shaft thereagainst.

BRIEF DESCRIPTION OF THE DRAWINGS

Further and more specific objects and advantages of the instant invention will readily occur to those skilled in the art from the following detailed description of preferred embodiments thereof taken in conjunction with the drawings in which.

DETAILED DESCRIPTION OF THE PREFERRED EMBODIMENTS

Figure 1:
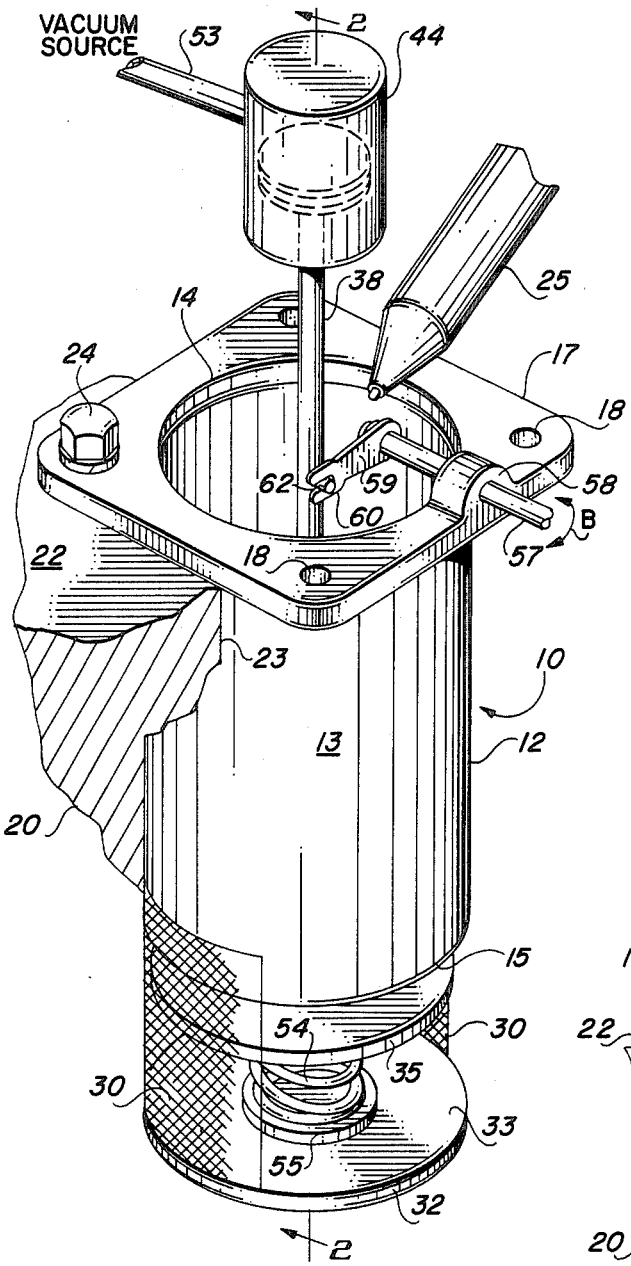
FIG. 1 is a perspective view of an atomizing valve apparatus embodying the principals of the instant invention and having portions of an internal combustion engine shown for purposes of orientation and semi-schematic fragmentary representation.

Turning now to the drawings in which like reference characters indicate corresponding elements throughout the several views, attention is first directed to FIG. 1 which illustrates an atomizing valve apparatus embodying the principles of the instant invention and generally designated by the reference character 10. The apparatus includes body 12 having external surface 13, inlet end 14 and discharge end 15. Mounting flange 17, having openings 18 therethrough, is affixed to body 12 proximate inlet end 14.

For purposes of orientation, atomizing valve apparatus 10 is shown as it would appear when installed in the fuel induction system of an internal combustion engine. For this purpose, there is shown a fragmentary portion of intake manifold 20 having mounting pad 22 with opening 23 therethrough. Opening 23 normal functions as the intake opening for receiving the fuel and air mixture from the normal fuel supply means, such as a carburetor which would be secured upon mounting pad 22. Exterior surface 13 of body 12 is sized and shaped to be received within opening 23. Mounting flange 17 bears upon mounting pad 22 and is secured thereto by bolts 24 which pass through openings 18 and are received within the conventional threaded apertures provided in mounting pad 22. Injector nozzle 25 represents a source of liquid fuel, such as gasoline. In accordance with conventional practice, ambient air which may have passed through a filter is available to inlet end 14.

Intake manifold 20 and injector 25, which is graphically portrayed in semi-schematic representation, are set forth herein for purposes of orientation and understanding in connection with the ensuing description. While shown cursorily, a complete and thorough understanding will be had by those skilled in the art. For example, it will be appreciated that opening 23 communicates with the interior of the intake manifold which in turn communicates with the one or several combustion chambers of the internal combustion engine.

Figure 2:
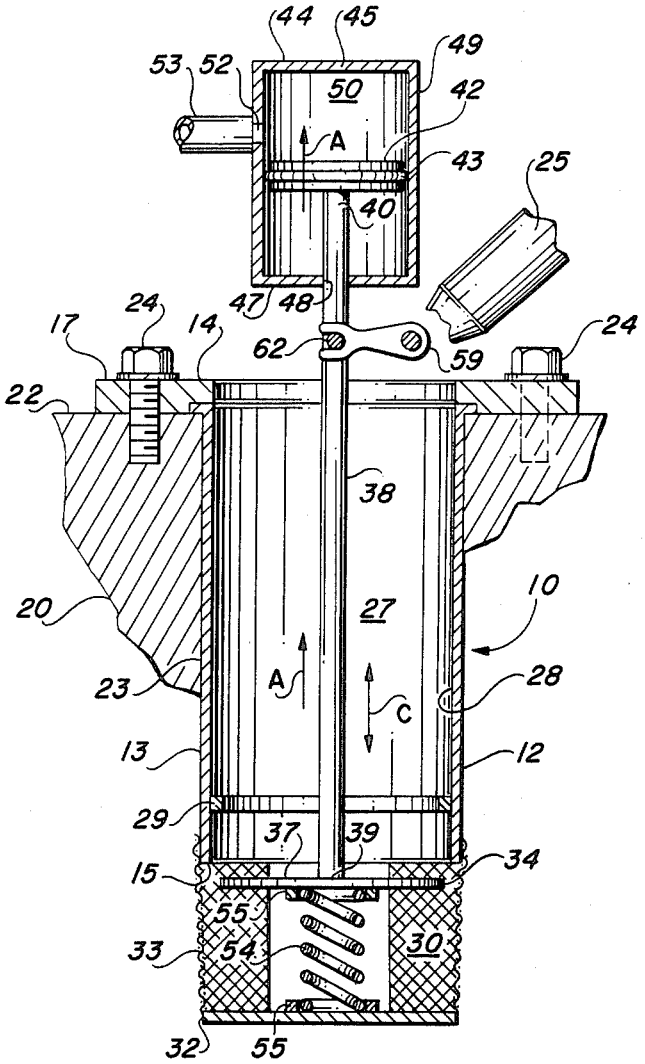
FIG. 2 is a vertical sectional view taken along the line 2—2 of FIG. 1.

With further reference to FIG. 2, it is seen that bore 27 having continuous sidewall 28 extends through body 12. For purposes of reference, inlet end 14 and discharge end 15 of body 12 are considered to be the equivalent elements of bore 27. Body 12 has a length that is sufficient to pass through bore 23 whereby discharge end 15 is at least flush with and preferably resides within intake manifold 20. An annular member or ring 29 in contact with sidewall 28 resides within bore 27 proximate discharge end 15.

A pair of diametrically opposed side panels 30, extending from body 10, support plate 32 at a fixed location from discharge end 15 of bore 27. Preferably, plate 32 is parallel to the discharge end 15 and perpendicular to the longitudinal axis of bore 27. The openings defined intermediate discharge end 15 and plate 32 and between side panels 30 are covered with a foraminous material such as screen 33. Further description, especially including the function, of side panels 30, plate 32 and screen 33, will be made presently.

Valve means of the immediate embodiment includes throttle valve 34 having a peripheral edge 35 and a generally planar surface 37. Edge 35 is generally concentric with the sidewall 28 of bore 27 while surface 37 is generally perpendicular to the axis of bore 27. Shaft 38 is affixed at one end 39 to throttle valve 34 and extends therefrom through bore 27. Preferably, shaft 38 is either concentric with sidewall 28 or parallel to the longitudinal axis of bore 27. At the other end 40 shaft 38 is affixed to piston 42 having peripheral seal 43. Cylinder 44 having closed ends 45 and 47 houses piston 42. Opening 48 in end 47 receives shaft 38 therethrough. Inner sidewall 49 slidingly and sealingly receives seal 43. Chamber 50 is formed within cylinder 44 between piston 42 and end 45. Opening 52 is formed through cylinder 44 in the area of chamber 50. Conduit 53 communicates between chamber 50 and a source of vacuum. The use of the intake manifold as a source of variable vacuum will be readily appreciated by those skilled in the art.

A coil spring 54 resides intermediate throttle valve 34 and plate 32. An annular member 55 affixed to plate 32 and a similar annular member 55 affixed to throttle valve 34 receive respective ends of spring 54. Annular members 55 function as retainers to prevent migration of spring 54 and to provide alignment to throttle valve 34. Spring 54, preferably a coil compression spring, normally urges throttle valve 34 in a direction toward discharge end 15 of bore 27 as illustrated by the arrowed line A.

Shaft 57 is journaled for rotary motion within boss 58 carried by mounting flange 17. Arm 59 extends radially from shaft 57 and is affixed thereto for rotation about the longitudinal axis of shaft 57. Fork 60 carried at the free end of arm 59 receives pin 62 projecting radially from shaft 38. Accordingly, as shaft 57 is rotated in counterdirections as indicated by the doubled arrowed arcuate line B, shaft 38, and consequently throttle valve 34, are moved in reciprocal linear directions as indicated by the doubled arrowed line C.

In accordance with the well known phenomena associated with normally aspirated engines, a fuel mixture of air and liquid is drawn into each of the several combustion chamber of the internal combustion engine. More specifically related to the instant invention, the mixture passes through bore 27 being received from the source through inlet end 14 and exiting into the intake manifold through discharge end 15. Assuming a ready available supply, the fuel/air mixture entering the intake manifold is regulated by the valve opening or distance between surface 37 of throttle valve 34 and discharge end 15 of body 12. Throttle plate 34 is extendible and retractable relative end 15 to vary the size of the opening and therefor the fuel charge supplied to the several combustion chambers in accordance with engine demand as will become apparent as the description ensues.

Normally, spring 54 assisted by the vacuum in chamber 50 urges throttle valve 34 in the retracted direction as indicated by the arrowed line A. Shaft 57 rotates in response to the linear movement of shaft 38. Accordingly, to limit the movement of throttle valve 34 to provide an opening size for fuel mixture flow commensurate with an engine operating at idle speed, stop means may be associated with shaft 57. Idle stop means are well known by those skilled in the art. Exemplary is the adjustable stop means normally associated with the throttle plate shaft of a conventional carburetor.

It is well known that for efficient engine operation, the fuel/air mixture should be as homogeneous as possible. That is, the liquid should be finely divided and entrained within the air stream. It is equally well known that larger droplets of fuel will tend to separate from the air stream and pool within the intake manifold. The instant invention provides primary and secondary means for atomizing the fuel thereby providing a flow of more uniform mixture to the several combustion chambers.

The path of fuel flowing through bore 27 is generally along the longitudinal axis thereof. Fuel flowing from discharge end 15 into the intake manifold will be generally radially outward. It is naturally tendency of large droplets of fuel to resist the change in direction. Accordingly, large droplets of fuel will fall from the mixture to be dashed against surface 37 of throttle valve 34. The larger droplets are immediately divided into several smaller droplets which will tend to sheet upon surface 37. Due to the differential in the cross-sectional area between bore 27 and the opening defined between throttle valve 34 and discharge end 15, the exiting fuel will accelerate. The accelerating stream will draw any settled fuel from surface 37 in a finely divided mist or atomized condition. Fuel already entrained within the air stream will be further atomized as a result of passing through a smaller opening at increased acceleration. Annular member 29 functions as a deflector to lift fuel in the region of sidewall 28 and direct same toward surface 37.

Screens 33 have a further homogenizing effect upon the fuel/air mixture. It is well known that the particle size of liquid moving in an air stream will be significantly reduced as a result of passing through a screen. This effect is increased in proportion to the velocity of the mixture passing through the screen. By providing primary and secondary atomizing means, the instant invention ensures that the fuel entering the intake manifold is highly ethereal.

It is conventional practice in the internal combustion engine art, to provide a single manifold to supply several cylinders. The intake opening resides at an intermediate location. The conventional four cylinder engine is cited as an example. The several cylinders are arranged in a single row having an elongate tubular manifold extending therealong. The intake opening is placed intermediate the two intermediate cylinders. Fuel flows in a first direction toward two of the cylinders and in a diametrically opposed direction toward the other two cylinders.

The throttle plate in a conventional carburetor, being rotatable about a transference axis, tends to act as baffle to direct fuel flow. Depending upon orientation of the axis, the throttle plate may direct more fuel in the direction of certain cylinders or against the side of the intake manifold. In the former case, certain of the cylinders will receive an overabundance of fuel while the others will receive insufficient fuel. In the later case, the liquid will have a tendency to condense and drop from the mixture. Conventional prior art atomizing valves which distribute fuel in equally proportioned radial directions, also suffer from the later malady.

The instant invention provides a remedy. Side panels 30 function as baffles for urging the flow of the fuel mixture in a direction toward the combustion chambers. The side panels also prevent the fuel from exiting the atomizing apparatus and immediately contacting the interior surface of the intake manifold.

It will be appreciated by those skilled in the art that as engine speed increases and greater pressure is drawn within the manifold, throttle valve 34 will be drawn in the extended position thereby increasing the size of the opening and the flow of fuel available to the engine. It is also contemplated by the instant invention that shaft 57 may be coupled into a stepping motor responsive to the electronic control module now commonly employed in motor vehicles. This will allow precise movement of throttle valve 34 as determined by the engine sensor which provide input into the electronic control module.

Figure 3:
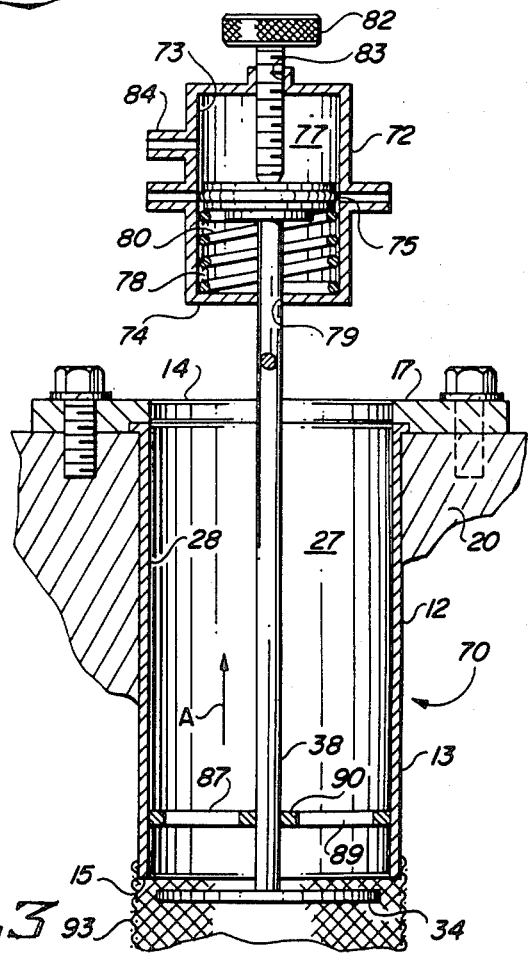
FIG. 3 is a view generally corresponding to the view of FIG. 2 and illustrating an alternate embodiment thereof.

With reference to FIG. 3 there is seen an alternate embodiment of the instant invention generally designated by the reference character 70. In common with the previously described embodiment 10, the immediate embodiment includes body 12 having exterior surface 13, inlet end 14, discharge end 15 and mounting flange 17. Bore 27 extending through body 12 between inlet end 14 and discharge end 15 includes continuous sidewall 28. Also provided are throttle valve 34 and shaft 38 extending upwardly therefrom.

In contrast to the previously described embodiment, the immediate embodiment includes cylinder 72 having closed ends 73 and 74. Transverse diaphragm 75 divides cylinder 73 into vacuum chamber 77 adjacent end 73 and spring housing 78 adjacent end 74. For ease of manufacture, chamber 73 may be fabricated of two cup-like components which are joined by bolts or other means and gripping diaphragm 75 therebetween.

The free end of shaft 38 passes through opening 79 in end 74 and is affixed to diaphragm 75. Spring 80 residing within spring housing 78, bears against end 74 and diaphragm 75 to normally urge shaft 38 and throttle valve 34 in the direction of arrowed line A. Adjusting screw 82 is threadably engaged within opening 83 in end 73. Nipple 84 functions as an attachment for a conduit, such as previously described conduit 53, for communication between chamber 77 and a source of engine vacuum.

Figure 4:
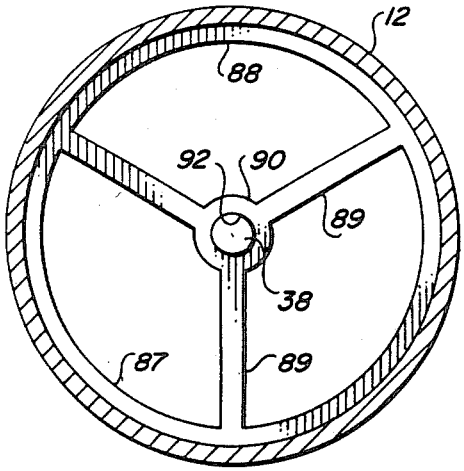
FIG. 4 is a vertical sectional view taken along the line 4—4 of FIG. 3.

An integral deflector and guide means, as seen with further reference to FIG. 4, is carried within bore 27. Preferably located proximate discharge end 15, member 87 includes annular portion 88 having spokes 89 projecting radially inward therefrom. Hub 90 carried at the inner end of spokes 89 has an opening 92 therethrough which functions as a bearing support for shaft 38. Opening 79 in end 34 functions as guide means for supporting the other end of shaft 38. A generally cup-shaped screen element 93 encompasses throttle valve 34 and is secured to body 12 proximate the discharge end 15 thereof.

In general, functioning of the immediate embodiment is analogous to the previously described functioning of the embodiment generally designated by the reference character 10. The immediate embodiment, however, includes integral idle adjustment means in the form of screw 82. The free end of screw 82 forms an abutment for diaphragm 75 and the free end of shaft 38 to limit the opening between throttle valve 34 and the discharge end 15 of bore 27 to a selective idle position.

Figure 5:
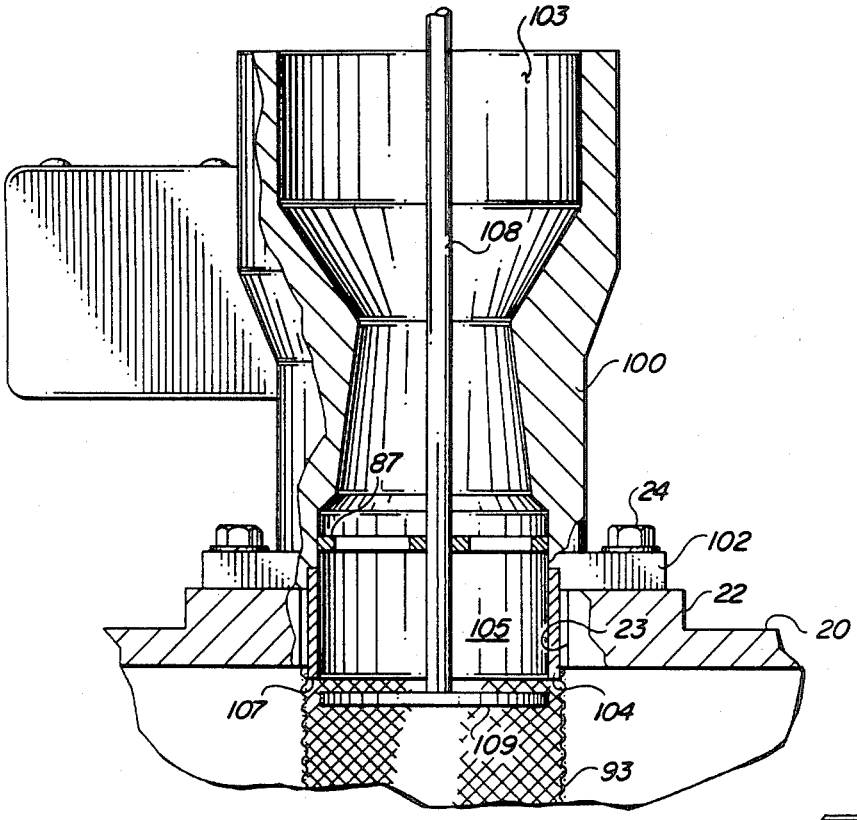
FIG. 5 is a vertical sectional view generally corresponding to the view of FIG. 2 and illustrating yet another embodiment of the instant invention.

The teachings of the instant invention are also adaptable to provide improvements to conventional carburetors. With reference to FIG. 5 there is seen a portion of a conventional carburetor including body 100 terminating at the lower end with flange 102 and secured to mounting pad 22 as by bolts 24. Bore 103, having the normal venturi section, extends through body 100. The foregoing portions of the carburetor are set forth for purposes for orientation and understanding in connection with the instant invention. Substantial structure has been omitted for purposes of clarity. However, portions not specifically illustrated and described will be readily visualized and understood by those having an appreciation for the art. It will noted, however, that the carburetor does not include the conventional throttle valve asembly.

The immediate embodiment of the invention includes a generally tubular body 104 affixed to the lower end of body 100 to depend through inlet opening 23 in intake manifold 20. In general, body 104 is analogous to previously body 12 and includes a bore 105 which is continuous with the bore 103 and terminates with a discharge end 107 within intake manifold 20. Shaft 108, supported within bore 103 by previously described deflector and guide means 87 carries valve member 109 at the lower end thereof. Cup-like screen element 93 depends from body 104 and encloses throttle valve 109.

The immediate embodiment of the instant invention provides various alternatives. In accordance with one configuration, there is provided improved structure as an alternative to the conventional throttle valve. Accordingly, shaft 108 may be provided with a pin 62 engaged with arm 59 and shaft 57 as described in detail in connection with FIGS. 1 and 2. The shaft 57 may be caused to operate by the throttle linkage normally utilized to operate the conventional throttle valve. Atomization of the liquid and controlled directional flow of the mixture are obvious advantages.

Alternately, shaft 108 may terminate within a cylinder, such as previously described cylinders 44 and 72 and throttle valve 109 caused to operate as previously described in detail. Accordingly, the carburetor functions as a fuel supply means for providing a mixture of air and liquid to the atomizing valve apparatus generally designated by the reference character 10 or 70 and previously described in detail.

Various changes and modifications to the embodiments herein chosen for purposes of illustration will readily occur to those skilled in the art. To the extent that such modifications and variations do not depart from the spirit of the invention, they are intended to be included within the scope thereof which is limited only by a fair assessment of the following claims.

Having fully described the invention, and alternate embodiments thereof, in such clear and concise terms as to enable those skilled in the art to understand and practice the same, the invention claimed is:

1. An apparatus for use in combination with the fuel induction system of an internal combustion engine, which internal combustion engine includes at least one combustion chamber, and which fuel inducation system includes fuel supply means of providing a fuel mixture of air and liquid and an inlet manifold having an inlet opening for normally receiving said fuel mixture and communicating with said at least one combustion chamber, a variable vacuum being drawn in said inlet manifold in response to operation of said engine, and for atomizing the liquid in said mixture and supplying a regulated flow of atomized mixture to said intake manifold in response to engine demand, said valve comprising:

a. a body including a bore having a continuous sidewall and having an inlet end for receiving said fuel mixture and a discharge end communicating with said intake manifold;

b. valve means including a throttle valve residing in the normal path of the fuel mixture exiting the discharge end of said bore;

c. guide means coupling said valve means to said body for reciprocal movement of said throttle valve in extendible and retractable directions relative the discharge end of said base; and d. biasing means normally urging said throttle valve in the retractable direction, said throttle valve being movable in the extendible direction in response to the vacuum in said manifold.

2. The apparatus of claim 1, wherein said throttle valve includes a surface cooperating with the discharge end of said bore for at least partially atomizing the liquid and for directing said mixture to flow substantially radially outward from said bore.

3. The apparatus of claim 2, further including baffle means for urging the flow of said mixture in a direction generally toward said at least one combustion chamber.

4. The apparatus of claim 1, further including deflector means carried within said bore for lifting said fuel mixture from the sidewall of said bore.

5. The apparatus of claim 4, wherein said deflector means includes an inwardly directed annular member.

6. The apparatus of claim 1, wherein:

a. said valve means includes a shaft extending from said throttle valve; and b. said guide means includes a bearing supporting said shaft for movement along the longitudinal axis thereof.

7. The apparatus of claim 6, wherein said guide means further includes bearing support means projecting from the sidewall of said bore and carrying said bearing.

8. The apparatus of claim 1, further including stop means for limiting the movement of said throttle valve in the retractable direction.

9. The apparatus of claim 8, wherein said stop means includes:

a. a shaft extending from said throttle valve in a direction toward the inlet end of said bore and having a free end; and b. an adjustably positionable stop member for receiving the free end of said shaft thereagainst.

10. The apparatus of claim 1, further including atomizing means for intercepting the fuel mixture intermediate the discharge end of said bore and said inlet manifold.

11. The apparatus of claim 10, wherein said atomizing means includes a screen element stationarily depending from the discharge end of said bore and encompassing said throttle valve.

* * * * *